United States Patent [19]

Ford et al.

[11] 4,414,728

[45] Nov. 15, 1983

[54] WHEEL RIM APPARATUS AND METHOD

[75] Inventors: Charles R. Ford; Stephen L. Gatsos, both of Indianapolis, Ind.

[73] Assignee: Indus Wheel Company, Cincinnati, Ohio

[21] Appl. No.: 265,668

[22] Filed: May 20, 1981

Related U.S. Application Data

[63] Continuation of Ser. No. 61,829, Jul. 30, 1979, abandoned.

[51] Int. Cl.[3] ..... B21H 1/10; B21K 1/38

[52] U.S. Cl. ..... 29/159.1; 72/354; 72/369

[58] Field of Search ..... 113/116 R, 116 D, 116 E; 29/159 A, 159.1, 159.01; 72/369, 367, 354, 402; 301/96, 97

[56] References Cited

U.S. PATENT DOCUMENTS 2,291,393 7/1942 LeJeune ..... 29/159.1

3,298,218 1/1967 Gollwitzer ..... 29/159.1

*Primary Examiner*—Mark Rosenbaum

*Attorney, Agent, or Firm*—Barnes & Thornburg

[57] ABSTRACT

A method and apparatus for forming wheel rims using a wheel rim blank having a well center region with a diameter equal to the diameter of the well center of the finished wheel rim. Two female die halves form a cavity to confine the wheel rim blank and two male dies cooperate with the female die halves to flare the bead seat regions of the wheel rim blank. The bead seat regions of the wheel rim blank are subsequently contoured to final dimensions between two additional female die halves by two additional male dies.

13 Claims, 1 Drawing Figure

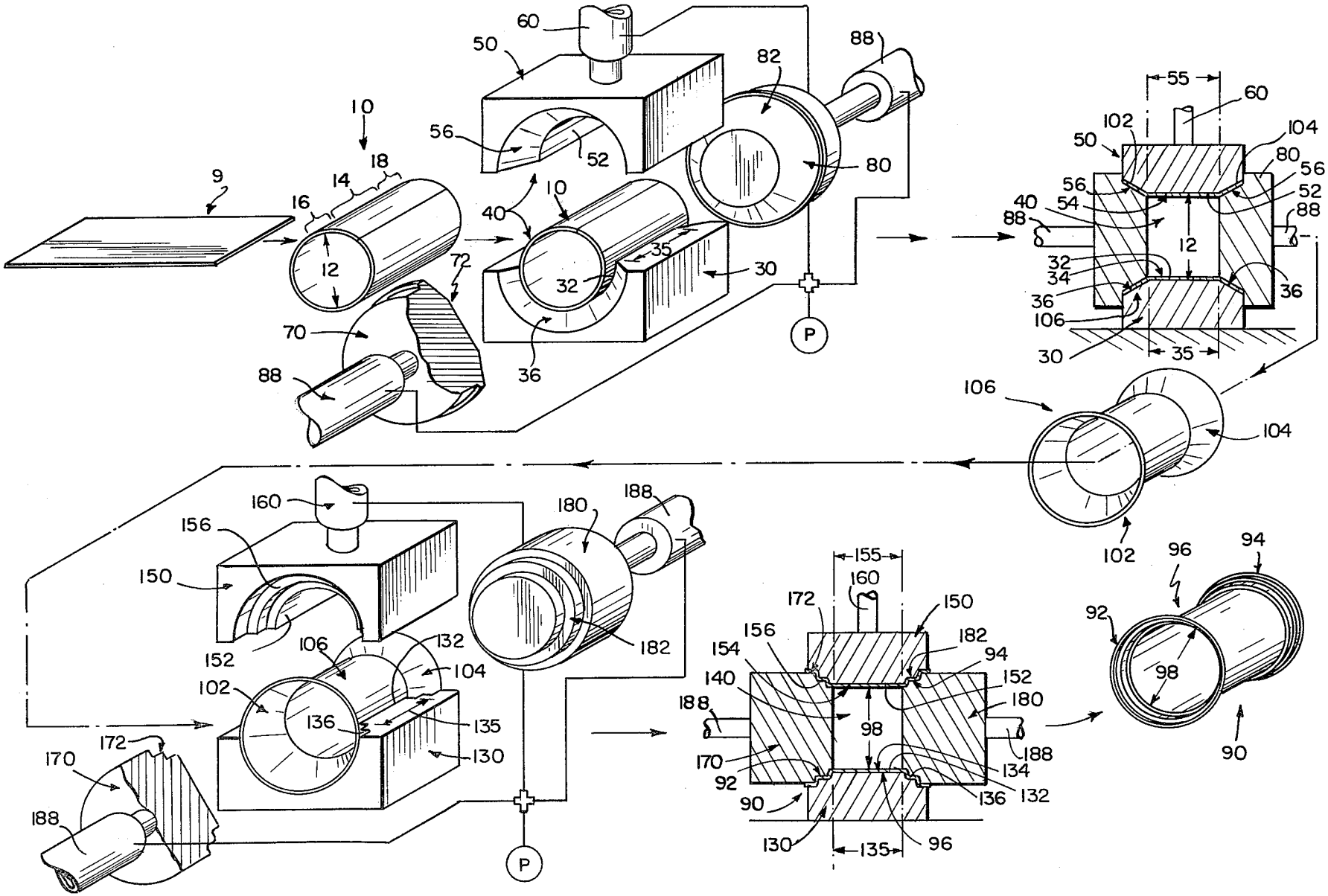
P
P

WHEEL RIM APPARATUS AND METHOD

This is a continuation of application Ser. No. 061,829, filed July 30, 1979, now abandoned.

The present invention relates to the manufacture of wheel rims and more particularly to a method and apparatus of forming wheel rims of the drop-center type wherein a wheel rim drop center of minimum diameter separates axially spaced wheel bead seats.

Generally speaking, the method of the present invention utilizes a cylindrical wheel rim blank with a well center region having a diameter equal to the finished diameter of the well center of the finished wheel rim. By employing a pair of female die halves, a cavity is formed having a minimum diameter which is equal to the diameter of the well center region of the wheel rim blank so that during the forming of the wheel rim, the diameter of the well center region of the wheel rim blank is maintained to form the well center. The ends of the cavity are contoured to flare the axial ends of the rim separated by the drop center for subsequent formation of the bead seats of the finished wheel rim. Two male dies are movable axially in opposite directions into and out of the cavity and the wheel rim blank to form the flares for subsequent formation of bead seats on the finished wheel rim. Then the partially formed rim is transferred to another pair of female dies defining a cavity, the ends of which are contoured to finish form the bead seats on the finished rim. Additional male dies are movable axially in opposite directions into and out of this last-mentioned cavity to contour the bead seat regions of the finished wheel rim.

In U.S. Pat. No. 2,291,393 issued to F. H. LeJeune, a method is disclosed for forming drop- or well-center wheel rims, wherein a wheel rim blank is utilized having an original diameter which is equivalent to the finished diameter of the well center region of the wheel rim. However, LeJeune teaches a method which requires a considerable number of independent steps in order to form the finished wheel rim. For example, a first die-preparing step expands and progressively reduces the thickness of the ends of the wheel blank by employing a first set of dies, a second die-pressing step contours the ends of the wheel blank by employing a second set of dies and an external confining device, and a third die-pressing step completes the fashioning of the wheel rim by employing a third set of dies.

Other methods and apparatus have been devised for forming drop-center wheel rims which employ dies for pressing the wheel blank into desired cross-sectional dimensions. See for example U.S. Pat. Nos. 3,298,218; 3,364,550; and 3,575,035. In these prior methods, a wheel blank is utilized which does not have finished dimensions. Typically in these methods, the wheel blank is either rolled or compressed in order to attain the desired cross-sectional dimensions of the wheel rim.

According to the method of the present invention, wheel rim blanks having a diameter which is equal to the outside diameter of the well- or drop-center region of the finished wheel rim are first formed to provide axially spaced flares in the regions where the wheel rim bead seats will be formed. An apparatus for accomplishing this method of forming wheel rims includes a pair of female die halves forming a cavity having a minimum diameter equal to the outside diameter of the well center of the finished wheel rim and two male dies movable axially into the blank to flare the axial ends of the blanks. Means are provided for reciprocating the male and female dies into and out of operative engagement with the wheel rim blank, whereby in a single reciprocation of the dies the flared wheel rim blank is formed.

Further according to the present invention, a second pair of female die halves forms a cavity having finished wheel dimension and contours. Two additional male dies are movable axially into the flared wheel rim blank to establish the finished contours of the wheel rim and bead seats.

Importantly, method and apparatus of the present invention are advantageous in forming wheels of relatively small diameters and large widths. In fact, it has been found that wheel rims can be manufactured by the present method which have smaller diameters and larger widths than have previously been obtainable using many prior methods. Due to the simplicity of the apparatus, the present invention is also advantageous in manufacturing small quantities of wheel rims having various diameters and widths. For example, to produce wheel rims of greater width, it is necessary only to replace the two female die halves forming the cavity for confining the wheel rim blank and flared wheel rim blank.

Other advantages and features of the present invention will become apparent from the following detailed description of an embodiment, and the accompanying drawing. The drawing is a flow diagram charting the steps of the method of the present invention with certain stages of the method and certain apparatus for performing the method being illustrated variously in perspective and vertical sectional views.

Referring now to the drawing, the method utilizes a substantially rectangular piece 9 of metal, such as steel, which is shaped into a cylindrical wheel rim blank 10 having a diameter 12 and a well center region 14 intermediate two bead seat regions 16 and 18. It is well known to those skilled in the art that there are many methods for forming and shaping the cylindrical wheel rim blank 10. Accordingly, it is not intended that the present invention be limited with respect to the process for shaping the metal to form the blank 10. As will be described in more detail hereinafter, the diameter 12 of the blank 10 also constitutes the finished outside diameter 98 of the well center 96 of the finished wheel rim 90.

Two diametrically opposed female die halves 30 and 50 cooperatively form a cavity 40 for confining the wheel rim blank 10. Each female die half includes a semicircular cross-section concave portion 32, 52, respectively, such that when the dies 30 and 50 are brought together, a cylindrical cavity 40 is formed. The central regions 34 and 54 of the concave portions 32 and 52 form a minimum diameter of the cavity 40 which is equal to the diameter 12 of the wheel rim blank 10, and the diameter 98 of the well center 96 of the finished wheel rim 90. The central regions 34 and 54 will have lengths 35, 55, respectively, which correspond approximately to the desired width of the well center 96 of the finished wheel rim 90. The end regions 36 and 56 of the concave portions 32 and 52 of the dies 30 and 50 are each contoured to provide flares in the blank after forming in the dies 30, 50, in regions corresponding to the locations of the bead seats 92 and 94 of the finished wheel rim 90. The regions 36 and 56, when operatively engaged with each other, form a part of the cavity 40 having inner dimensions and contours which are equal to the outside dimensions of the flares 102 and 104 of the flared wheel rim blank 106.

A means 60 is associated with at least one of the female die halves 30 for relatively reciprocating the die halves 30 and 50 into and out of operative engagement. By way of illustration, the reciprocating means 60 may include a hydraulic mechanism which gradually moves one of the female die halves 50 into and out of operative engagement with the other die half 30 to confine a wheel rim blank 10 in the cavity 40 formed by the engagement of the two die halves 30 and 50. Further, by way of illustration, it may be desirable to hinge the two die halves 30 and 50 together along one side so that by manipulating one of the die halves 30 or 50, the die halves are moved into and out of engagement.

Two cooperating male dies 70 and 80 are movable axially into the cavity 40 formed by the female die halves 30 and 50 and into the wheel rim blank 10 which is confined by the female die halves 30 and 50. The male dies 70 and 80 are movable in opposite directions and each has associated with it means 88 for reciprocating the dies 70 and 80 into and out of the cavity 40 and the bead seat regions 16 and 18 of the wheel rim blank 10. Although any reciprocating means 88 well known in the art may be used, for illustrative purposes the reciprocating means 88 may again include hydraulic mechanisms having two synchronous rams for forcing the dies 70 and 80 into the cavity 40 and for removing the dies 70 and 80 from the cavity 40 upon completion of the flared wheel rim blank. It should be noted that the female die half 50 may move coincidently with the male dies 70 and 80 in a coincident movement of each die, or the female die halves 30 and 50 may first be engaged, and then the male dies moved into the cavity 40. If all of dies 30, 50, 70, and 80 operate coincidently, the flared wheel rim blank 106 is formed from the wheel rim blank 10 in a single reciprocation of the female and male dies 30, 50, 70, and 80. Each male die 70 and 80 includes a region 72 and 82, respectively, which is shaped to correspond to the contours of the ends 36 and 56 of the cavity 40. The dimensions and contours of regions 36 and 56 of the cavity 40, and the dimensions and contours of the regions 72 and 82 of the male dies 70 and 80 correspond to the dimensions and contours of the flared regions 102, 104 of the flared wheel rim blank 106.

Two diametrically opposed female die halves 130 and 150 cooperatively form a cavity 140 for confining the flared wheel rim blank 106. Each female die half 130, 150 includes a semicircular cross-section concave portion 132, 152, respectively, such that when the dies 130 and 150 are engaged, a cylindrical cavity 140 is formed. The central regions 134 and 154 of the concave portions 132 and 152 form a minimum diameter of the cavity 140 which is equal to the diameter 12 of the wheel rim blank 10, and the diameter 98 of the well center 96 of the finished wheel rim 90. The central regions 134 and 154 will each have lengths 135, 155, respectively, which corresponds to the desired width of the well center 96 of the finished wheel rim 90. The end regions 136 and 156 of the concave portions 132 and 152 of the dies 130 and 150 are contoured to correspond to the bead seats 92 and 94 of the finished wheel rim 90. Each contoured region 136 and 156, when operatively engaged with each other, form a part of the cavity 140 having inner dimensions and contours which are equal to the outside dimensions of the beads 92 and 94 of the final wheel rim 90.

Associated with each of the female die halves 130 and 150 is means 160 for moving the die halves 130 and 150 into and out of operative engagement. Again, the reciprocating means 160 may include a hydraulic mechanism having a ram which moves the female die half to 150 into and out of operative engagement with die half 130 to confine the flared wheel rim blank 106 in the cavity 140 formed by the engagement of the two die halves 130 and 150. It may be desirable to hinge the two die halves 130 and 150 along one side so that by manipulating the opposing side of one of the die halves 130 or 150, they are moved into and out of engagement.

Two cooperating male dies 170 and 180 are movable axially into the cavity 140 formed by the female die halves 130 and 150 and into the flared wheel rim blank 106 which is confined by the female die halves 130 and 150. The male dies 170 and 180 are movable in opposite directions and each has an associated means 188 for reciprocating the dies 170 and 180 into and out of the cavity 140. The reciprocating means 188 may again include a hydraulic mechanism having two synchronous arms or rams for moving the dies 170 and 180 into and from the cavity 140 during the wheel rim forming process. It should be noted that the female die half 150 may move coincidental with the male dies 170 and 180, or the female die halves 130 and 150 may first be moved into operative engagement, and then the male dies moved into the cavity 140. If all of dies 130, 150, 170, and 180 operate coincidentally, the finished wheel rim 90 is formed from the flared wheel rim blank 106 in a single reciprocation of the female and male dies 130, 150, 170, and 180. Each male die 170 and 180 includes a region 172 and 182, respectively, which is shaped to correspond to the contours of the ends 136 and 156 of the cavity 140. The dimensions and contours of regions 136 and 156 of the cavity 140, and the dimensions and contours of the regions 172 and 182 of the male dies 170 and 180 correspond to the dimensions and contours of the beads seats 92 and 94 of the finished wheel rim 90.

As illustrated, the finished wheel rim 90 formed from the wheel rim blank 10 in accordance with the method described hereinabove has a well center region 96 having a diameter 98 equal to the diameter 12 of the wheel rim blank.

What is claimed is:

1. A method of forming a wheel rim from a wheel rim blank having a well center region separating axially spaced wheel bead seat regions, the well center region of the blank having a finished diameter, consisting of a first step of simultaneously confining the well center region of the blank to maintain the finished diameter thereof and flaring the bead seat regions of the blank on each side of the well center region, and a second step of simultaneously confining the well center region of the blank to maintain the finished diameter thereof and final fashioning the flared bead seat regions to form a bead seat on each side of the well center region.

2. The method as recited in claim 1 wherein the first step is performed by providing first and second female die halves movable into engagement to define a first cavity having a well center region with an inside diameter equal to the outside diameter of the well center region of the blank, and regions spaced apart by the well center region for flaring the bead seat regions of the blank.

3. The method as recited in claim 2 wherein the second step is performed by providing third and fourth female die halves movable into engagement to define a second cavity having an inside diameter equal to the outside diameter of the well center region of the blank, and contoured regions corresponding to the inside contours of the bead seats for final fashioning the flared bead seat regions.

4. The method as recited in claim 3 wherein the bead seat regions of the blank are flared by providing first and second male dies movable generally axially in opposite directions into the first cavity.

5. The method as recited in claim 4 wherein the bead seat regions of the blank are final fashioned by providing third and fourth male dies movable generally axially in opposite directions into the second cavity.

6. The method as recited in claim 4 or 5 wherein the female die halves and the male dies move coincidently into and out of operative engagement with said wheel rim blank.

7. A method of forming a well center wheel rim from a wheel rim blank having a well center region separating axially spaced wheel bead seat regions, the well center region of the blank having finished inside and outside diameters, consisting essentially of a first step of coincidently moving first and second female die portions and first and second male dies to confine the well center region of the blank and to flare the bead seat regions of the blank on either side of the well center region, the first and second female die portions being moved into engagement with each other to define a cavity having an inside diameter equal to the outside diameter of the finished well center region of the wheel rim blank, and the first and second male dies being moved generally axially in opposite directions into the cavity defined by the female die portions, and a second step of coincidently moving third and fourth female die portions and third and fourth male dies to confine the well center region of the blank and final fashion the flared bead seat regions to form a bead seat on each side of the well center region, the third and fourth female die portions being moved into engagement to define a cavity having an inside diameter equal to the outside diameter of the well center region of the rim blank with flared bead seat regions and finished well center region, and the third and fourth male dies being moved generally axially in opposite directions into the cavity defined by the third and fourth female die portions.

8. An apparatus for forming a wheel rim consisting of a first pair of cooperating female die halves, means for reciprocating the first female die halves into and out of operative engagement, the first female die halves in operative engagement defining a first cavity having a minimum diameter equal to the outside diameter of the well center region of a wheel rim blank and the well center of the finished wheel rim, a first pair of cooperating male dies movable axially in opposite directions into and out of the first cavity to form flared portions in the bead seat regions of the wheel rim blank, the first female die halves and the first male dies being movable coincidently into and out of operative engagement with the wheel rim blank and the flared portions being axially separated by the well center, a second pair of cooperating female die halves, means for reciprocating the second female die halves into and out of operative engagement, the female die halves in operative engagement defining a second cavity having a minimum diameter equal to the outside diameter of the well center region of a wheel rim blank and the well center of the finished wheel rim, and a second pair of cooperating male dies movable axially in opposite directions into and out of the second cavity to fashion the flared portions in the bead seat regions of the wheel rim blank, the second female die halves and the second male dies being movable coincidently into and out of operative engagement with the wheel rim blank.

9. The apparatus as recited in claim 8 wherein each end of the first cavity is flared and has dimensions equal to the outside dimensions of the flared portion of the flared wheel rim blank.

10. The apparatus as recited in claim 9 wherein each end of the second cavity is contoured and has dimensions equal to the outside dimensions of the bead seat of the finished wheel rim.

11. The apparatus as recited in claim 10 wherein a portion of each of the first pair of male dies is contoured and has dimensions equal to the inside dimensions of the flared portion of the flared wheel rim blank.

12. The apparatus as recited in claim 11 wherein a portion of each of the second pair of male dies is contoured and has dimensions equal to the inside dimensions of the bead seat of the finished wheel rim.

13. An apparatus for forming a well center wheel rim from a wheel rim blank having axially spaced bead seat regions separated by a well center region, the apparatus consisting essentially of a first pair of cooperating female dies, first means for reciprocating the first female dies into and out of operative engagement, the first female dies in operative engagement defining a first cavity having a minimum diameter equal to the outside diameter of the well center region of the wheel rim blank and the outside diameter of the well center of the finished wheel rim, the apparatus further including a cooperating pair of first male dies, and second means for reciprocating the first male dies in opposite directions axially into and out of the first cavity to form flared regions in the axially spaced bead seat regions, the first and second reciprocating means being synchronously operative to coincidently move the first female and male die pairs, a second pair of cooperating female dies, third means for reciprocating the second female dies into and out of operative engagement, the second female dies in operative engagement defining a second cavity having a minimum diameter equal to the outside diameter of the well center region of the flared wheel rim blank and the outside diameter of the well center of the finished wheel rim, the apparatus further including a cooperating pair of second male dies, and fourth means for reciprocating the second male dies in opposite directions axially into and out of the cavity to form bead seats on the axially spaced flared bead seat regions, the third and fourth reciprocating means being synchronously operative to coincidently move the second female and male die pairs.

* * * * *